United States Patent [19]

Nicklous

[11] Patent Number: 4,460,113

[45] Date of Patent: Jul. 17, 1984

[54] NEEDLEWORK TOOL AND FINGER PROTECTOR

[76] Inventor: Rebecca E. Nicklous, W. 2423 Decatur, Spokane, Wash. 99208

[21] Appl. No.: 260,199

[22] Filed: May 4, 1981

[51] Int. Cl.[3] ..... D05B 91/04

[52] U.S. Cl. ..... 223/101; D3/29

[58] Field of Search ..... 223/101, 1, 99; 2/21, 2/20; D3/29; 66/1 A; 294/25; 128/77, 87 A

[56] References Cited

U.S. PATENT DOCUMENTS

| | | | |
|---|---|---|---|
| Re. 17,271 | 4/1929 | Foulke | 128/87 A |
| 190,897 | 5/1877 | Porter . | |
| 474,237 | 5/1892 | Frost | 2/21 UX |
| 1,375,690 | 4/1921 | George | 2/21 |
| 1,380,410 | 6/1921 | Parry | 2/21 |
| 2,179,046 | 11/1939 | Lewis | 2/21 |
| 2,461,872 | 2/1949 | Beatty . | |
| 2,461,970 | 2/1949 | Finegan . | |
| 2,588,528 | 3/1952 | Howser . | |
| 4,127,222 | 11/1978 | Adams . | |

FOREIGN PATENT DOCUMENTS

| | | | |
|---|---|---|---|
| 381055 | 10/1907 | France | 128/77 |
| 403828 | 10/1969 | France | 223/101 |
| 22367 | of 1892 | United Kingdom | 24/259 R |

OTHER PUBLICATIONS

DePuy Finger Splint Advertisement, 1937.

DePuy Finger Splint Advertisement, 1943.

Richards Manufacturing Company, JB & JS, vol. 46-A, No. 3, 04/1964, p. 66.

Richards Fracture and Orthopedic Supplies, May 9, 1966.

*Primary Examiner*—Robert Mackey

*Attorney, Agent, or Firm*—Wells, St. John & Roberts

[57] ABSTRACT

A finger protector for hand needlework is comprised of a thin flat metal sheet folded onto itself. The two flat folded sections of the sheet can be bent about a transverse fold line to allow access between facing surfaces by the user's fingers. The sheet is thus held while the smooth curve at the fold or one of the outwardly facing surfaces is positioned against the material workpiece. A needle forced through the material may strike the exposed protector surface and be deflected away from the finger below. The needle can be guided over the smooth curved surface and redirected back through the fabric.

3 Claims, 5 Drawing Figures

NEEDLEWORK TOOL AND FINGER PROTECTOR

BACKGROUND OF THE INVENTION

The present invention relates to finger protectors for hand sewing operations and more particularly to such protectors having flat exposed surfaces for engagement by a needle.

The most commonly known finger protector is the thimble. The typical thimble is a hollow, frusto-conical item having its small end closed. It is permanently sized to fit over the end of a finger. The exposed outer surfaces of thimbles are usually roughened and curved continuously about central axes. The closed ends are also roughened and usually substantially dome-shaped.

The conventional thimble is designed to protect the finger it covers from being punctured by needles. Thimbles are used both for protecting the finger from needle points as well as for pushing needles through heavy material. The roughened surfaces prevent deflection of the needle from the curved thimble surfaces. Materials used in thimble construction have included metal, ceramics, plastics, and rubber. Variations of the standard thimble configuration are shown in the 1877 patent to Porter (U.S. Pat. No. 190,897) 1952 Patent to Howser, (U.S. Pat. No. 2,588,528) and a more recent patent granted in 1978 to Adams (U.S. Pat. No. 4,127,222). Adams discloses a slightly different configuration, with a fingernail accomodating projection at its closed end. The Adams thimble is constructed with curved outward surfaces resembling the natural slope of a fingertip.

Until the advent of the present invention, only gloves, thimbles and "finger cots" have been used for finger protection. Heavy leather or similar material is used especially in finger cots as disclosed in U.S. Pat. Nos. 2,461,872 and 2,461,970 to Beatty and Finegan, respectively. They are basically leather strips that have been sewn or folded into a finger pocket configuration. The leather is molded or shaped to resemble the natural curved finger configuration without any substantially flat surfaces. Also, the function of the leather is primarily to protect finger tissues from abrasion rather than puncture by needles.

The present invention represents a significant advancement in needlework accessories by providing a finger protector that is useful in virtually any form of needlework, such as quilting, crewel, embroidery, cross-stitch, patchwork, mending, applique, candlewicking, etc. The present invention has flat, rigid surfaces on opposite sides of a smooth curved surface against which the needle will strike as it passes through the sewing material. The surfaces protect the fingers and may deflect the needle away from the finger without requiring that the needle be stopped or pulled back before starting the return or upward stitch. Accuracy and speed in hand stitching techniques are therefore greatly enhanced by use of the present invention.

An object of the present invention is to provide a simple yet versatile and very effective needlework finger protector that can be used to deflect a needle toward a return or upward stitch while also protecting the fingers that support it.

A further object is to provide such a finger protector that can be used in a variety of positions to allow precise needlework in relatively confined areas.

Another object is to provide such a finger protector that can be easily adjusted to fit a variety of finger sizes.

Another object is to provide such a finger protector that can be used effectively to produce straighter rows and smaller stitches than are normally produced using a standard thimble.

An additional object is to provide such a finger protector that can be used on the fingers of either hand.

These and still further objects and advantages will become apparent upon reading the following description, which, taken with the accompanying drawings, describes a preferred form of the present invention.

DETAILED DESCRIPTION OF A PREFERRED EMBODIMENT

Figure 1:
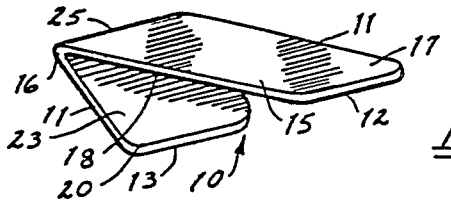
FIG. 1 is a pictorial view of the present invention.

A needlework protector embodying a preferred form of the present invention is generally shown in the drawings by the reference number 10. The present protector 10 is comprised of a folded elongated sheet of a flexible metal. The sheet includes elongated longitudinal sides 11 spaced apart by transverse ends 12 and 13. The preferred dimensions of the sheet before it is folded onto itself as shown in the drawings, is one inch by two inches. It is also preferred that the material used is stainless steel, particularly type 430 cold rolled stainless steel with a thickness dimension of at least 0.007 inches. It is noted, however, that the above referred dimensions are exemplary of a preferred form of the sheet and that other dimensions may be used as well.

As briefly discussed above, the sheet is folded onto itself. A first flat section 15 is therefore defined by the sides 11, one end 12 and a transverse fold 16. The fold 16 extends across the width of the sheet and is preferably parallel to the end edges 12 and 13. First and second flat section surfaces 17 and 18 are defined on opposite facing sides of the section 15.

A second flat section 20 is also provided as an integral part of the sheet. The second section 20 is defined by the elongated sides 11, the remaining transverse end 13, and the fold 16. The second flat section includes oppositely facing first and second flat surfaces 21 and 23.

Figure 2:
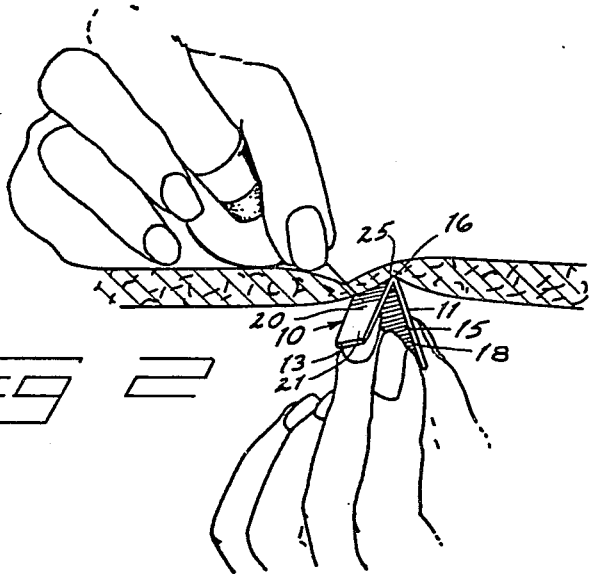
FIG. 2 is a view showing the present stitchwork finger protector in use with framed or hoop work.
Figure 3:
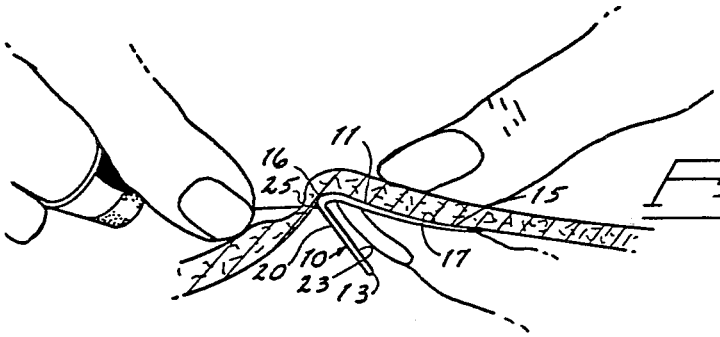
FIG. 3 is a view showing the position of the finger protector when used with hand-held work.
Figure 4:
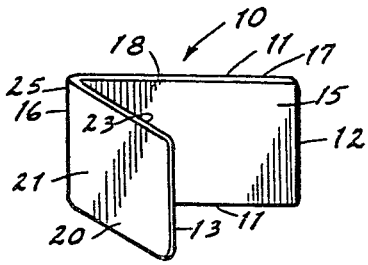
FIG. 4 is a pictorial view of the finger protector similar to FIG. 1 only showing opposite surfaces thereof.

It may be noted that the dimension between the end 13 and fold line 16 is less than the dimension between the end 12 and fold 16. The end 13 therefore overlies the second surface 18. The longitudinal dimension between the ends 12 and 13 and the fold 16 are such that either section 20 can be easily grasped between the thumb and forefinger as shown in FIGS. 2 and 3, so the surface opposite the index fingernail faces the needle. However gripped, the protector can be moved with the finger without the end edges 12 and 13 gouging or chaffing against the skin.

The first and second sections 15 and 20 of the sheet are bent at the fold 16 (FIG. 5) to form an acute angle relative to one another. This angle can be varied due to the inherent ability of the sheet matrial to be bent.

Figure 5:
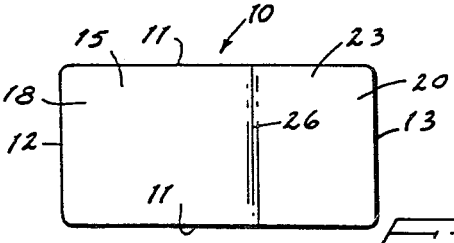
FIG. 5 is a flat pattern lay-out of the protector.

An important feature of the present invention is a smooth curved surface 25 formed at the fold 16. The curved surface 25 represents a smooth, uniform transition or juncture of the first surfaces 17 and 21. It is important that the curved surface be smooth and of a relatively small radius from a center fold line 26 (FIG. 5). The smooth surface 25 will allow the needle to slide freely. Also, because of the small radius of curvature, the surface facilitates use in confined areas and small, accurate stitch work.

The bend radius from the fold line 26 is preferred to be approximately 0.02 inches when material thickness is at 0.007 inches. This radius will vary in relation to the thickness of the sheet material.

Preferably the protector will be marketed with the second flat section 20 folded into close proximity with the first flat section 15 so that the surface 23 of section 20 is nearly parallel with surface 18 of section 15. The sections can later be bent apart prior to use.

The angle between the two sections will vary according to the size of the user's fingers, as the forefinger or forefinger and middle finger are intended to fit between the facing surfaces 23 and 18 as shown in FIG. 2. The typical angle used is approximately 30°. Again, however, this angle may vary infinitely with the preference of the user, so long as the smooth curve surface 25 at the junction of surfaces 17 and 21 is maintained.

It is noted that the exposed surfaces of the sheet (surfaces 21 and 17) are smooth and flat. A needle pushed through material backed by the present protector will strike the smooth surface and be deflected or stopped thereby. The needle can then be pushed on through the material with the point sliding over the smooth curved surface 25.

Operation of the present invention can vary with the nature of the work being done. For example, FIG. 3 shows a preferred position for the protector when handwork is being done without the aid of a frame or hoop. FIG. 2 shows a position that can be used for frame or hoop work. This protector can also be used in confined areas or where very precise, short stitches are to be used.

In the FIG. 3, position, the longer first flat section 15 is held flush with the underside of the work. This is done with the index finger being inserted between the surfaces 23 and 18 and with the surface 23 over the fingernail. The longer first section 15 is held with the work between the index finger and thumb. The protector is held under and against the under-surface of the work with the surface 21 held nearly perpendicular to the needle. The needle will penetrate the material and strike the smooth surface 21 close to the curved surface 25. The fold 16 is then moved under the needle tip and the eye of the needle is pivoted down toward the work to slide the needle point over the smooth curved surface 25, guiding it back through the material to complete the stitch.

Any available corners or edges of the protector can be used in addition to the surfaces 17 and 21, and 25 to elevate small areas of the material in confined areas or for close work.

It may be desirable to hold the protector in a substantially vertical position as shown in FIG. 2 when the material is supported by a frame or hoop. Here, the curved surface 25 is held flush against the underside of the fabric and at substantially right angles to the penetrating needle. The needle can be inserted until it touches the protector. The protector can then be moved back under the tip of the needle to push the needle point back upwardly. The eye of the needle is pushed back down simultaneously so it will slide up and over the surface 25 and through the fabric. Again, any of the corners or surfaces available can be used as suited, depending upon the nature of the work being done.

Having thus described the invention, what I claim is:

1. A needlework tool and finger protector for receiving a finger of a needlecraft artist and being positioned against the underside of a needlecraft fabric to assist a needlecraft artist to stitch evenly spaced hand stitches from the upper side of the needlecraft fabric using a hand needle with a sharp pointed end while protecting the artist's finger from the sharp pointed end of the needle, comprising:

a V-shaped sheet metal body having first and second sheet metal leg sections extending divergently outward from a fold apex at an acute angle;

said first leg section having a smooth imperforate and flat sheet metal surface extending from the fold apex a prescribed length distance to a smooth and continuous transverse first section terminal edge, the prescribed length distance being less than the normal distance of the needlecraft artist finger from its second joint to its tip;

said second leg section having a smooth imperforate and flat sheet metal surface extending from the fold apex a prescribed length distance to a smooth and continuous transverse second section terminal edge, the prescribed distance of the second leg section being less than the prescribed length distance of the first leg section;

said fold apex having a radius of curvature considerably less than the normal radius of curvature of the artist's fingertip for enabling the apex to be forced upward against the underside of the needlecraft fabric to cause the sharp needle end to initially engage one of the leg sections as the end is thrust downward through the fabric and to be deflected upward over the apex and back through the fabric to form an evenly spaced hard stitch without endangering the supporting finger.

2. The needlework tool and finger protector as defined in claim 1 wherein the sheet metal body is formed of stainless steel.

3. The needlework tool and finger protector as defined in claim 1 wherein the sheet metal body has a uniform thickness dimension of at least 0.007 inches.

* * * * *